US006854837B2

(12) United States Patent
Hashimoto et al.

(10) Patent No.: US 6,854,837 B2
(45) Date of Patent: Feb. 15, 2005

(54) INK SUPPLY SYSTEM AND INK SUPPLY METHOD FOR STENCIL PRINTER AND INK CONTAINER

(75) Inventors: Hirohide Hashimoto, Ibaraki-ken (JP); Masakatsu Arai, Ibaraki-ken (JP); Kaoru Kimura, Ibaraki-ken (JP); Kenji Oshima, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 10/454,504

(22) Filed: Jun. 5, 2003

(65) Prior Publication Data

US 2003/0227523 A1 Dec. 11, 2003

(30) Foreign Application Priority Data

| | | |
|---|---|---|
| Jun. 6, 2002 | (JP) | 2002-165552 |
| Jan. 29, 2003 | (JP) | 2003-019852 |
| May 13, 2003 | (JP) | 2003-134168 |

(51) Int. Cl.[7] ..... B41J 2/175; B41F 31/00
(52) U.S. Cl. ..... 347/85; 101/350.1
(58) Field of Search ..... 347/85–87; 101/127, 101/350.1

(56) References Cited

U.S. PATENT DOCUMENTS

| | | | | |
|---|---|---|---|---|
| 5,673,073 A | * | 9/1997 | Childers et al. | 347/86 |
| 6,192,797 B1 | * | 2/2001 | Rea et al. | 101/202 |
| 2001/0003953 A1 | | 6/2001 | Wakayama et al. | |

FOREIGN PATENT DOCUMENTS

EP 1 153 754 A1 11/2001

OTHER PUBLICATIONS

European Search Report dated Sep. 26, 2003.

* cited by examiner

*Primary Examiner*—Thinh Nguyen
(74) *Attorney, Agent, or Firm*—Nixon Peabody LLP; Donald R. Studebaker

(57) ABSTRACT

A piston-type ink container is inserted into an ink container holder of a stencil printer so that an ink suction nozzle of the stencil printer is fitted in a small diameter portion of the ink container to suck the ink in the ink container through an ink discharge port on the tip of the small diameter portion. A vacuum release mechanism at least partly releases vacuum in the space evacuated by the ink suction nozzle before the tip of the nozzle and the tip of the small diameter portion are aligned with each other when the ink container is drawn from the ink container holder.

25 Claims, 10 Drawing Sheets

INK SUPPLY SYSTEM AND INK SUPPLY METHOD FOR STENCIL PRINTER AND INK CONTAINER

BACKGROUND OF THE INVENTION

1. Field of the Invention

This invention relates to a system for and a method of supplying ink to a stencil printer. This invention also relates to an ink container which is mounted on a stencil printer to supply ink to the stencil printer.

2. Description of the Related Art

There has been known a stencil printer in which print is made by the use of an image-wise perforated stencil. In such a stencil printer, a stencil is made by, for instance, bringing a thermal head having a plurality of heater elements arranged in a row or rows into contact with heat-sensitive stencil material with the heater elements selectively energized according to the image to be printed, thereby image-wise perforating the stencil material. The stencil thus made is wound around a printing drum and a printing paper is pressed against the stencil so that ink is transferred to the printing paper through the perforations. As a means for supplying ink to the stencil printer, there has been employed a mechanism comprising an ink supply roller which is supported for revolution about their respective axes by a pair of opposed plate, a distributor which supplies ink onto the ink supply roller and a doctor roller which is disposed spaced from the ink supply roller to control the thickness of ink film formed on the roller. As the distributor, those comprising a tubular member provided with a plurality of small holes or comprising a plurality of nozzles have been known. Ink in an ink container is sucked by an ink pump and is supplied onto the ink supply roller in the form of drops so that an ink fountain is formed in the wedge-like space between the ink supply roller and the doctor roller. Ink in the ink fountain is supplied into the printing drum through the gap between the ink supply roller and the doctor roller. A predetermined amount of ink is constantly held in the ink fountain so that ink can be uniformly supplied. That is, each time an ink sensor detects shortage of ink in the ink fountain, the ink pump is operated to replenish the ink fountain with ink. When the ink fountain is not replenished with ink after driving the ink pump for a predetermined time, the ink container is considered to be exhausted and the user is prompted to replace the ink container.

As the ink container employed in the stencil printer, there have been known, for instance, those comprising an outer box formed of corrugated board and a flexible inner bag accommodated in the outer box so that an ink discharge pipe formed on one end of the inner bag projecting outside the outer box with the outer end thereof closely sealed with a cap (will be referred to as "a BIC-type ink container", hereinbelow) and those comprising a cylinder provided with an ink discharge port on the front thereof and a piston inserted into the cylinder (will be referred to as "a piston-type ink container", hereinbelow). The latter piston-type ink container is advantageous over the former BIC-type ink container in that the amount of ink remaining in the ink container after ink is sucked to the very end is smaller and ink can be effectively used. In this ink container, an ink discharge port is formed on the front end of a small diameter portion and the ink container is sealed by a cap which is screwed on the ink discharge port. When using the ink container, the cap is unscrewed and the ink container is inserted into the stencil printer from the container holder of the stencil printer so that the ink suction port of the stencil printer is fitted with the small diameter portion of the ink container.

When the ink container is exhausted and ink therein comes not to be sucked out, the ink container must be replaced with a new ink container. When replacing the ink container, the vicinity of the ink suction port of the stencil printer can be stained with ink ejected from the ink container unless the ink container is carefully handled. The ink on the vicinity of the ink suction port of the stencil printer can stain the outer surface of the loaded ink container, and the ink on the outer surface of the loaded ink container can stain the user's hand in turn when the loaded ink container is exhausted and removed from the stencil printer.

Even an exhausted ink container is not completely free from ink but some ink remains near the ink discharge port. Further, since ink is sucked from the ink container through the ink suction port, the inside of the ink container and the ink suction port of the stencil printer is under vacuum. When the ink container is rapidly drawn out in this state, ink remaining around the junction of the ink container can be ejected out under the shock of drawing the ink container. This phenomenon is apt to occur in the piston-type ink containers and is less apt to occur in the BIC-type ink containers. It is believed that this is because ink remaining around the ink discharge port is returned inside the inner bag when the inner bag recovers its original shape in the case of the BIC-type ink containers whereas such effect cannot be expected in the case of the piston-type ink containers where the piston is substantially rigid.

SUMMARY OF THE INVENTION

In view of the foregoing observations and description, the primary object of the present invention is to provide an ink supply system for and an ink supply method of supplying ink to a stencil printer by the use of a piston-type ink container which can prevent ejection of ink due to a negative pressure inside the ink container during replacement of the ink container.

Another object of the present invention is to provide a piston-type ink container adapted to accomplish the above object.

In accordance with the present invention, an ink container comprising a cylinder provided with a substantially cylindrical body portion and a small diameter portion which is formed on one end of the body portion and is provided with an ink discharge port on its free end, a piston inserted into the body portion of the cylinder to be slidable in the axial direction of the body portion along the inner peripheral surface thereof toward the small diameter portion, and ink filled in the space formed between the inner surface of the body portion and the surface of the piston facing the small diameter portion is inserted into an ink container holder of a stencil printer so that the small diameter portion of the ink container is fitted with an ink suction nozzle which sucks the ink in the ink container through the ink discharge port, and vacuum in the space evacuated by the ink suction nozzle is at least partly released by a vacuum release means before the tip of the nozzle and the tip of the small diameter portion are aligned with each other when the ink container is drawn from the ink container holder.

The ink suction nozzle may be either fitted in or on the small diameter portion of the ink container. That is, the ink suction nozzle may be inserted into the small diameter portion, or the small diameter portion may be inserted into the ink suction nozzle.

It is preferred that a sealing means for sealing the joint between the nozzle and the small diameter portion be provided between the nozzle and the small diameter portion. The sealing means may be an annular elastic sealing member which may be, for instance, an O-ring. The annular elastic sealing member may be provided either on the nozzle or on the small diameter portion.

For example, "the tip of the nozzle and the tip of the small diameter portion are aligned with each other" when they are in the relative position shown in FIG. 5D.

The vacuum release means may be any means so long as it can at least partly release the vacuum in the space between the inner surface of the body portion of the cylinder and the surface of the piston facing the small diameter portion but need not be limited to those which completely release the vacuum.

The vacuum release means may comprise, for instance, a projection provided on one of the outer surface of the ink container and the inner surface of the ink container holder (which is substantially cylindrical in shape) and a guide groove formed on the other of the outer surface of the ink container and the inner surface of an ink container holder to engage with the projection to guide the projection when the ink container is drawn from the ink container holder so that the ink container drawing speed is reduced or the ink container is once stopped to allow the vacuum in said space to be at least partly released before the tip of the nozzle and the tip of the small diameter portion are aligned with each other.

For example, the guide groove includes a helical portion through which the projection is moved between a time point at which sealing of said space is broken and a time point at which the tip of the nozzle and the tip of the small diameter portion are aligned with each other and which is inclined so that the ink container drawing speed is reduced to allow the vacuum in said space to be at least partly released before the tip of the nozzle and the tip of the small diameter portion are aligned with each other. Otherwise, the guide groove may be provided with a bent portion through which the projection is moved between a time point at which sealing of said space is broken and a time point at which the tip of the nozzle and the tip of the small diameter portion are aligned with each other and which is bent so that the ink container is once stopped to allow the vacuum in said space to be at least partly released before the tip of the nozzle and the tip of the small diameter portion are aligned with each other.

The "time point at which sealing of said space is broken" is a time point at which sealing of said space is broken during drawing the small diameter portion away from the nozzle.

Further, the projection may be provided on a ring member mounted on the outer surface of the body portion of the cylinder of the ink container for rotation about the axis of the body portion whereas the guide groove to be engaged with the projection is formed on the inner surface of the ink container holder and is provided with a helical portion so that the ink container drawing speed is reduced to allow the vacuum in said space to beat least partly released before the tip of the nozzle and the tip of the small diameter portion are aligned with each other. In this case it is preferred that a predetermined friction be produced between the outer surface of the body portion of the cylinder and the ring member or between the projection and the guide groove.

In one embodiment, the projection extends on the outer surface of the body portion of the cylinder in the axial direction of the body portion by a length not smaller than the radius of the body portion whereas the guide groove is formed on the inner surface of the ink container holder. In this case, the front end (the end nearer to the discharge port) of the projection abuts against an end face of the guide groove to guide the projection when the ink container is drawn from the ink container holder so that the ink container drawing speed is reduced or the ink container is once stopped.

It is preferred that the front end of the projection be at a distance from the front face of the body portion of the cylinder in the range not smaller than 0 mm and not larger than 35 mm.

Further it is preferred that the body portion of the cylinder be smaller than 100 mm in its diameter and the projection be not larger than 120 mm in its length when.

Further, the vacuum release means may comprise a plurality of small vent holes formed along the small diameter portion of the ink container in the case of where the ink suction nozzle is fitted in the small diameter portion.

In accordance with the present invention, splash of ink can be prevented since the vacuum in the space filled with the ink is at least partly released before the ink suction nozzle is entirely drawn away from the small diameter portion of the ink container (before the tip of the nozzle and the tip of the small diameter portion are aligned with each other) and accordingly, ejection of ink due to that the space which has been kept under a vacuum is abruptly subjected to the atmospheric pressure.

When the projection is provided on a ring member mounted for rotation on the outer surface of the body portion of the cylinder of the ink container, it is not necessary to rotate the ink container itself when the ink container is drawn out from the ink container holder.

When the length of the projection is not smaller than the radius of the body portion, the projection and the guide groove are engaged with each other over a larger area and the posture of the ink container is stabilized during insertion and drawing of the ink container into and from the ink container holder, whereby workability is improved and the projection is improved in strength and durability. As the front end of the projection is nearer to the front end of the ink container, displacement of the front end of the projection due to swelling of the ink container becomes less and can guide the ink container more accurately when the ink container is drawn from the holder. Especially, when the front end of the projection is at a distance not larger than 35 mm from the front face of the body portion of the cylinder, change in dimensions due to swelling of the ink container can be suppressed, and splash of ink can be suppressed even in an aged ink container.

When the projection is not larger than 120 mm in its length when the cylinder is smaller than 100 mm in its diameter, change in dimensions due to swelling of the ink container can be suppressed.

DESCRIPTION OF THE PREFERRED EMBODIMENTS

Figure 1:
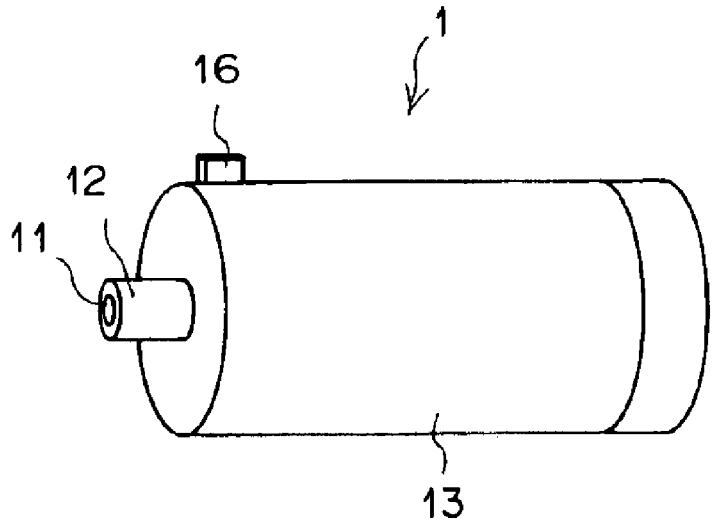
FIG. 1 is a perspective view showing the ink container employed in the ink supply system in accordance with a first embodiment of the present invention.
Figure 2:
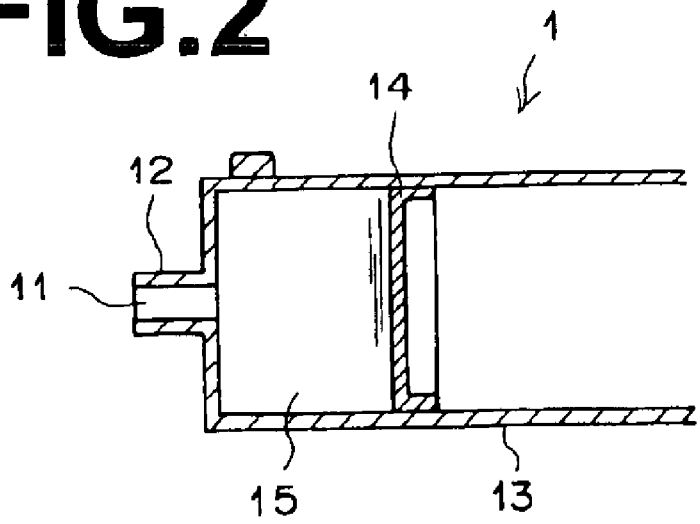
FIG. 2 is a cross-sectional view of the ink container.

An ink supply system for a stencil printer in accordance with a first embodiment of the present invention comprises an ink container 1 shown in FIG. 1. As shown in FIG. 1, the ink container 1 comprises a cylinder. The cylinder comprises a substantially cylindrical body portion 13 and a small diameter portion 12 which is formed on one end of the body portion 13 and is provided with an ink discharge port 11 on its free end. A piston 14 is inserted into the body portion 13 of the cylinder to be slidable in the axial direction of the body portion 13 along the inner peripheral surface thereof toward the small diameter portion 12. Ink is filled in the space 15 (FIG. 2) formed between the inner surface of the body portion 13 and the surface of the piston 14 facing the small diameter portion 2. A projection 16 is fixedly provided on the outer surface of the body portion 13 near the small diameter portion side end thereof.

Figure 3:
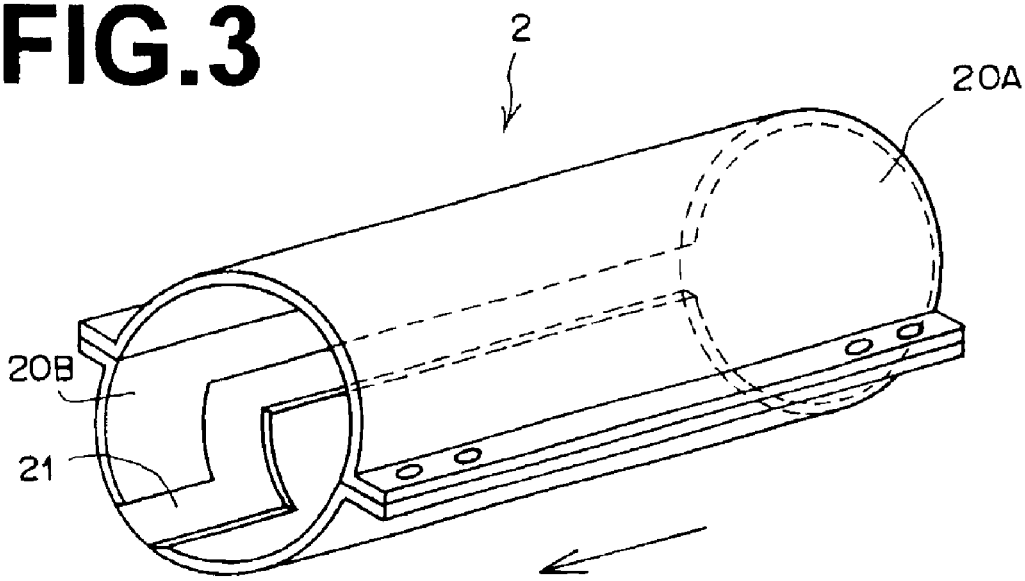
FIG. 3 is a perspective view showing an ink container holder of the ink supply system.

The ink container 1 is inserted into an ink container holder provided on the stencil printer (not shown). As shown in FIG. 3, the ink container holder 2 is substantially a cylindrical member open at opposite ends thereof. The ink container 1 is inserted into the ink container holder 2 through an opening 20A at one end (rear end) thereof so that an ink suction nozzle 31 (FIG. 4) of the stencil printer disposed near to an opening 20B at the other end (front end) of the ink container holder 2 is fitted in the small diameter portion 12 of the ink container 1. A cranked guide groove 21 is formed on the inner surface of the ink container holder 2 to engage with the projection 16 to guide the projection 16 when the ink container 1 is inserted into and drawn out from the ink container holder 2. That is, the guide groove 21 comprises a circumferential portion and a pair of axial portions which extend in the axial direction of the body portion 13, in which the ink container 1 is inserted into and drawn out from the ink container holder 2, from the upper and lower ends of the circumferential portion. When the ink container 1 is drawn out from the ink container holder 2, the ink container 1 is first pulled rearward so that the projection 16 is moved along the lower axial portion of the guide groove 21 until the projection 16 abuts against one end wall (the right end wall as seen in FIG. 3) of the circumferential portion where the ink container 1 is once stopped, then the ink container 1 is counterclockwise rotated so that the projection 16 is moved along the circumferential portion until the projection 16 is aligned with the upper axial portion of the guide groove 1, and then the ink container 1 is pulled rearward again so that the projection 16 is moved along the upper axial portion of the guide groove 21 until the projection 16 is disengaged from the guide groove 21. The circumferential portion of the guide groove 21 is formed between an axial position of the body portion 13 where the projection 16 exists upon a time point at which sealing of the space in which ink is filled is broken and an axial position of the body portion 13 where the projection 16 exists upon a time at which the tip of the nozzle 31 and the tip of the small diameter portion 12 are aligned with each other (need not be formed at the middle between the axial positions). It is preferred that the length of the circumferential portion be selected so that the ink container 1 may be rotated by an angle not larger than 180° from the viewpoint of facilitation of insertion into and drawing out the ink container 1 from the ink container holder 2.

Figure 4:
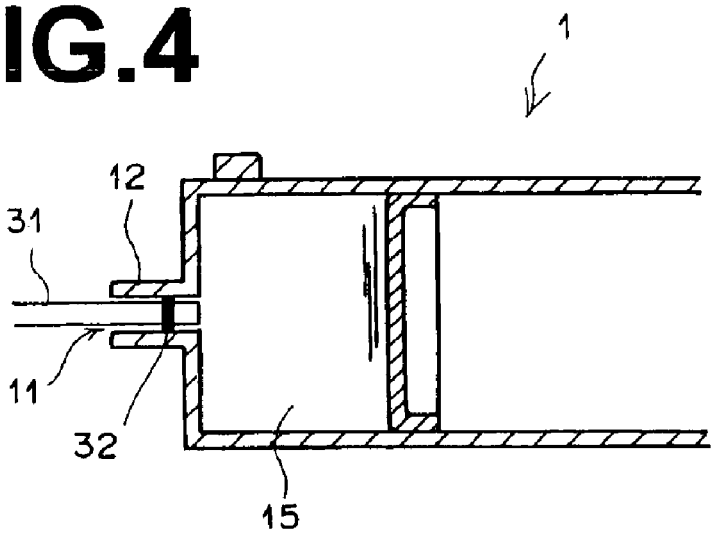
FIG. 4 is a cross-sectional view showing an ink suction nozzle fitted in the small diameter portion of the ink container.

The ink suction nozzle 31 is fitted, as shown in FIG. 4, in the small diameter portion 12 with an O-ring 32 interposed therebetween to suck the ink in the ink container 1 through the ink discharge port 11.

Figure 5A:
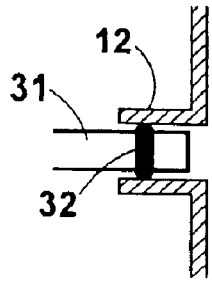
FIGS. 5A to 5E are views showing the relationships of the small diameter portion of the ink container and the ink suction nozzle of the stencil printer at different stages of drawing the ink container from the ink container holder.
Figure 5B:
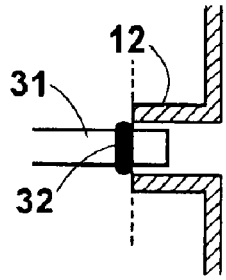
Figure 5C:
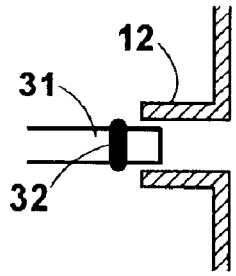
Figure 5D:
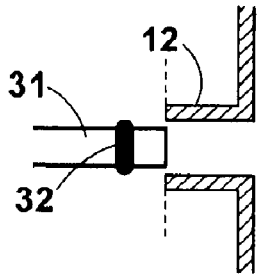
Figure 5E:
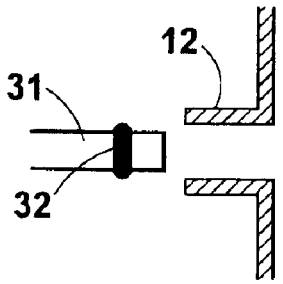

Operation of the ink supply system of this embodiment will be described, hereinbelow. When the ink container 1 is replaced, the old ink container 1 is first drawn out from the ink container holder 2 before a new ink container 1 is inserted into the ink container holder 2. At this time, since the space 15 between the inner surface of the body portion 13 and the surface of the piston 14 is sealed and the ink in the space 15 has been sucked by the ink suction nozzle 31, the inside of the old ink container 1 is kept under a vacuum. While the ink container 1 is drawn out from the ink container holder 2, the projection 16 of the ink container 1 is kept in engagement with the guide groove 21 on the inner surface of the ink container holder 2 and is moved along the guide groove 21. When the ink container 1 is drawn out from the ink container holder 2, the ink container 1 is pulled rearward in a state shown in FIG. 5A where the ink suction nozzle 31 is fitted in the small diameter portion 12 of the ink container 1 with the O-ring 32 hermetically sealing the joint therebetween. At this time, the projection 16 is moved along the lower axial portion of the guide groove 21 until the projection 16 abuts against the right end wall of the circumferential portion of the guide groove 21 and the ink container 1 is once stopped by the abutment of the projection 16 against the right end wall of the circumferential portion of the guide groove 21. FIG. 5B shows a state just before sealing of the joint between the small diameter portion 12 and the ink suction nozzle 31 is broken. Thereafter, the ink container 1 is counterclockwise rotated so that the projection 16 is moved along the circumferential portion (FIG. 5C shows the relationship between the small diameter portion 12 and the nozzle 21 in this state) until the projection 16 abuts against the upper end wall of the circumferential portion of the guide groove 21 and the projection 16 is aligned with the upper axial portion of the guide groove 21, and then the ink container 1 is pulled further rearward so that the projection 16 is moved along the upper axial portion of the guide groove 21 until the ink container 1 is drawn from the ink container holder 2 and the small diameter portion 12 is drawn away from the nozzle 31 as shown in FIG. 5E. FIG. 5D shows the state where the tip of the nozzle 31 and the tip of the small diameter portion 12 are aligned with each other.

In the ink supply system of this embodiment, since the ink container 1 is once stopped and the vacuum in said space 15 is allowed to be at least partly released before the ink suction nozzle 31 is moved outside the small diameter portion 12, the ink suction nozzle 31 restrains the ink from being ejected outside under the shock of drawing the ink container 1.

Figure 6A:
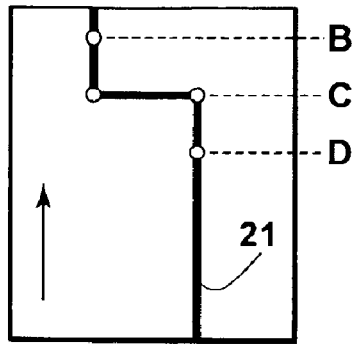
FIGS. 6A to 6D are views showing modifications of the guide groove formed on the ink container holder.
Figure 6B:
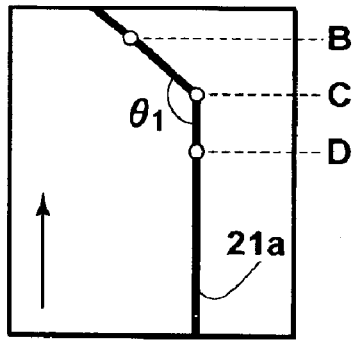
Figure 6C:
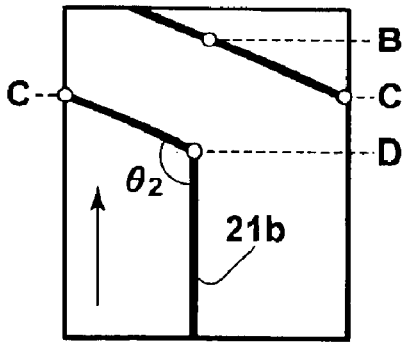
Figure 6D:
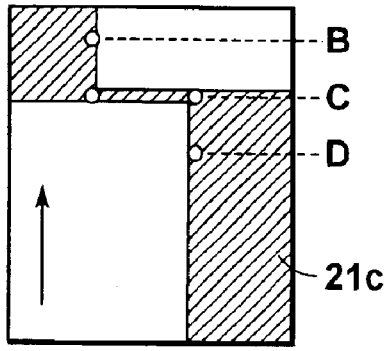

The shape of the guide groove 21 formed on the inner surface of the ink container holder 2 need not be limited to that shown in FIG. 3 but may be variously modified, for instance, as shown in FIGS. 6B to 6D. FIG. 6A shows, in a developed state, the guide groove 21 employed in the first embodiment and FIGS. 6B to 6D show modifications of the guide groove 21 in a developed state. Points B, C and D shown in FIGS. 6A to 6D respectively correspond to the axial positions where the nozzle 31 and the small diameter portion 12 are in relative positions shown in FIGS. 5B, 5C and 5D.

In the modification shown in FIG. 6B, a guide groove 21*a* includes a helical portion extending from the front end of the ink container holder 2 to the point C and an axial portion extending rearward from the point C with an angle θ1 sufficient to once stop the ink container 1 made between the helical portion and the axial portion. The angle θ1 is preferably larger than 90° and not larger than 150°, and more preferably larger than 90° and not larger than 135°. The portion of the guide groove 21*a* extending rearward from the point C need not extend in parallel to the axial direction of the body portion 13 of the ink container 1 so long as it can once stop the ink container 1 at the point C.

In the modification shown in FIG. 6C, a guide groove 21*b* includes a helical portion extending from the point B to the point D and adapted to reduce the ink container drawing speed to allow the vacuum in said space 15 to be at least partly released and an axial portion extending rearward from the point D with an angle θ2 made between the helical portion and the axial portion. The angle θ2 is preferably larger than 90° and not larger than 135°, and more preferably larger than 90° and not larger than 120°. The portion of the guide groove 21*b* extending rearward from the point D need not extend in parallel to the axial direction of the body portion 13 of the ink container 1. The guide groove 21*b* may comprise any other portion in place of the helical portion so long as it can reduce the ink container drawing speed to allow the vacuum in said space 15 to be at least partly released. For example, the guide groove 21*b* may comprise, a corrugated portion in place of the helical portion.

A guide groove 21*c* in accordance with the modification shown in FIG. 6D is similar to the guide groove 21 employed in the first embodiment but differs from the guide groove 21 in that the guide groove 21*c* is partly wider than the projection 16. The part of the guide groove 21*c* wider than the projection 16 may be of any shape so long as the guide groove 21*c* can once stop the ink container 1 at the point C, and may be, for instance, triangular.

Though, in the embodiment and the modifications described above, the projection 16 is provided on the ink container 1 and the guide groove 21 is provided on the ink container holder 2, the projection 16 may be provided on the ink container holder 2 with the guide groove 21 provided on the ink container 1. The guide groove 21 need not be a groove in the strict sense but may be, for instance, a groove-like portion between a pair of rows of projections or a row of projections which abuts against the projection 16 to guide insertion and drawing of the ink container 1.

Figure 7A:
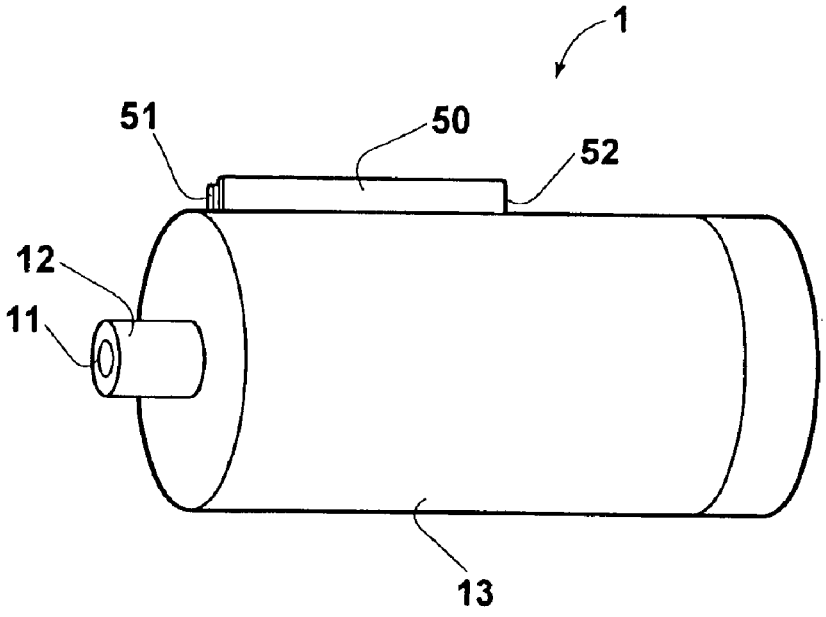
FIG. 7A is a perspective view showing an ink container in accordance with a second embodiment of the present invention.
Figure 7B:
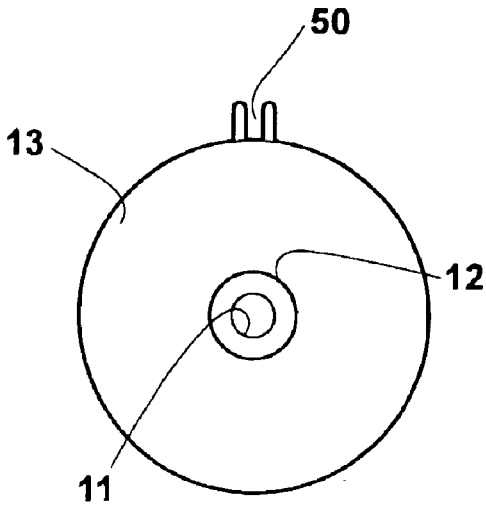
FIG. 7B is a front view of the ink container shown in FIG. 7A.
Figure 8:
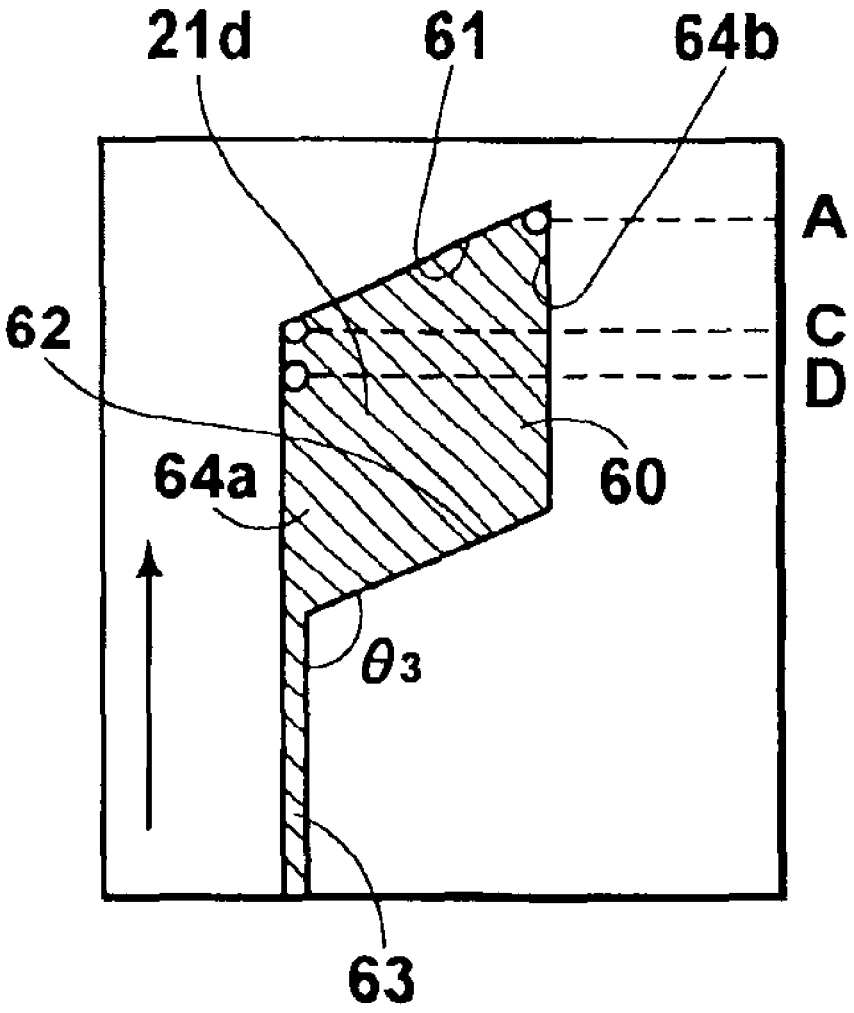
FIG. 8 is a view showing a guide groove to be engaged with the protrusion formed on the ink container shown in FIGS. 7A and 7B, FIGS. 9A and 9B are views showing modifications of the ink container shown in FIGS. 7A and 7B.

FIGS. 7A and 7B show an ink container 1 in accordance with a second embodiment of the present invention. As shown in FIGS. 7A and 7B, a protrusion 50 which is formed by a pair of sub-protrusions extending in the axial direction of the body portion 13 of the cylinder in parallel to each other by a length larger than the radius of the body portion 13 is provided on the outer surface of the body portion 13. The protrusion has a front end 51 and a rear end 52. FIG. 8 shows, in a developed state, a guide groove 21*d* to be formed on the inner surface of the ink container holder 2 to be engaged with the protrusion 50. The guide groove 21*d* comprises a helical wide portion 60 and a straight narrow portion 63. The wide portion 60 is at an angle θ3 to the straight narrow portion 63. (This angle θ3 will be referred to as "the drawing angle θ3", hereinbelow) The wide portion 60 has front and rear ends 61 and 62 and lower and upper edges 64*a* and 64*b*. The front and rear ends 61 and 62 are spaced from each other by a distance substantially equal to the length of the protrusion 50. The lower edge 64*a* of the wide portion 60 is flush with the lower edge of the narrow portion 63. When loading the ink container 1 of this embodiment, the ink container 1 is inserted straight into the ink container holder 2 so that the protrusion 50 is moved along the narrow portion 63 of the guide groove 21*d* until the rear end 52 clears the rear end 62 of the wide portion 60. Then the ink container 1 is counterclockwise rotated until the protrusion 50 abuts against the upper edge 64*b* of the wide portion 60 (the angle by which the ink container is rotated will be referred to as "the circumferential rotating angle", hereinbelow), during which the rear end 62 of the wide portion 60 pushes the rear end 52 of the protrusion 50 whereby the ink suction nozzle 31 is inserted into the small diameter portion 12 of the ink container 1, i.e., the rear end 62 of the wide portion 60 guides the ink container 1 to a fitting position where the ink suction nozzle 31 is inserted into the small diameter portion 12 of the ink container 1.

The old ink container 1 is drawn out from the ink container holder 2 in the following manner. In a state where the ink suction nozzle 31 is hermetically engaged with the small diameter portion 12 of the ink container 1 as shown in FIG. 5A, the front end 51 of the protrusion 50 is in the point A. While the ink container 1 is clockwise rotated and the front end 51 of the protrusion 50 is moved to the point C, sealing of said space 15 is broken but the ink suction nozzle 31 is still in the small diameter portion 12 when the front end 51 of the protrusion 50 is moved to the point C, and accordingly the ink suction nozzle 31 restrains the ink from being ejected outside under the shock of drawing the ink container 1. When the front end 51 of the protrusion 50 is moved to the point C, the ink container drawing speed is reduced or the ink container is once stopped and the vacuum in said space 15 is allowed to be at least partly released. Thereafter, the ink container 1 is pulled rearward with the protrusion 50 moved along the narrow portion 63 of the guide groove 21*d*. At a time point at which the front end 51 of the protrusion 50 passes through the point D, the tip of the nozzle 31 and the tip of the small diameter portion 12 is aligned with each other.

Figure 9A:
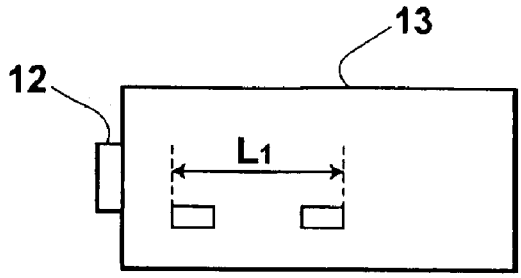
Figure 9B:
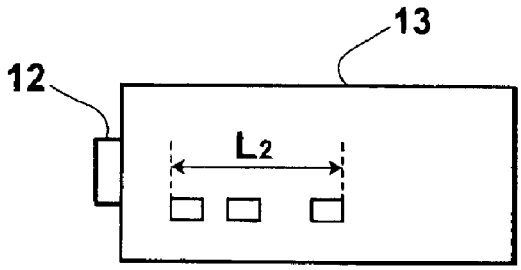
Figure 10:
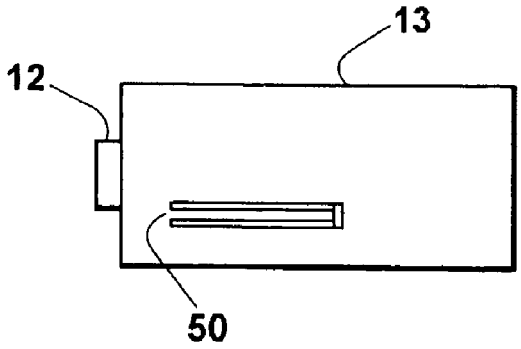
FIG. 10 is a view showing another modification of the ink container shown in FIGS. 7A and 7B.

The protrusion 50 need not be formed of a pair of parallel sub-protrusions as shown in FIGS. 7A and 7B but may be of various shapes on the basis of the mechanical strength of the protrusion 50. For example, the protrusion may be formed on a ring member mounted on the body portion 13 of the cylinder for rotation about the axis of the body portion 13. The protrusion 50 may be divided into two or more portions in the longitudinal direction thereof as shown in FIGS. 9A and 9B. In this case, the length of the protrusion is the distance between the front end of the foremost portion and the rear end of the rearmost portion as indicated at L1 or L2 in FIG. 9A or 9B. In the case where the protrusion is formed of a plurality of sub-protrusions, the protrusion can be reinforced by connecting the sub-protrusions as shown in FIG. 10. Though, in FIG. 10, the sub-protrusions are connected at their rear ends, the sub-protrusions may be connected at their front ends.

The guide groove which guides the protrusion 50 need not be limited to that shown in FIG. 8 but may be of any shape so long as it is provided with ends for guiding the front and rear ends of the protrusion. For example, the guide groove may be that 21*e* shown in FIG. 11 which is provided with a helical portion inclined at a predetermined angle with respect to the axial direction of the body portion 13 and extending from the points A to E.

Figure 12:
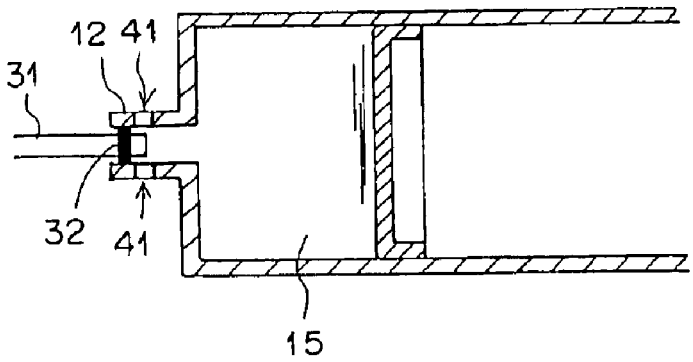
FIG. 12 is a view showing a modification of the vacuum release means.
Figure 13A:
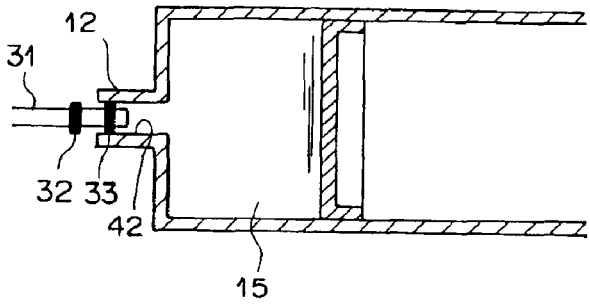
FIGS. 13A and 13B are views showing another modification of the vacuum release means.
Figure 13B:
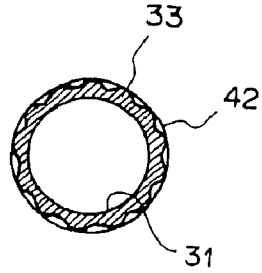

The vacuum release means may comprise at least one vent hole 41 as shown in FIG. 12 or a corrugated O-ring 33 which has corrugations on the outer peripheral surface thereof and fitted on the ink suction nozzle 31 on the outer side (the side nearer to the tip of the nozzle 31) of the O-ring 32 as shown in FIGS. 13A and 13B.

In the vacuum release means shown in FIG. 12, the space 15 is communicated with the atmosphere through the vent hole 41 to break the vacuum in the space 15 when the O-ring 32 passes the vent hole 41 before the tip of the nozzle 31 and the tip of the small diameter portion 13 are aligned with each other. In the vacuum release means shown in FIGS. 13A and 13B, the space 15 is communicated with the atmosphere through the recessed portion of the corrugated O-ring 33 to break the vacuum in the space 15 when the O-ring 32 passes the end of the small diameter portion 12 before the tip of the nozzle 31 and the tip of the small diameter portion 13 are aligned with each other.

Figure 14:
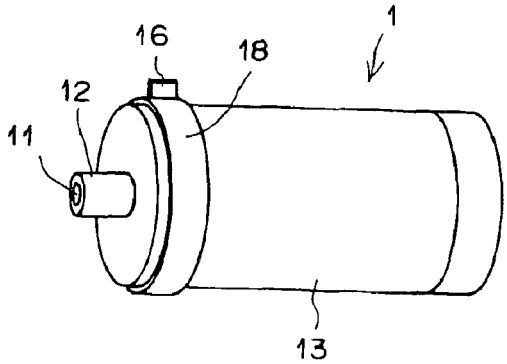
FIG. 14 is a perspective view showing the ink container in accordance with a third embodiment of the present invention.

The projection 16 may be provided on a ring member 18 mounted on the outer surface of the body portion 13 of the cylinder of the ink container 1 for rotation about the axis of the body portion 13 as shown in FIG. 14. In this case it is preferred that a predetermined friction be produced between the outer surface of the body portion 13 of the cylinder and the ring member 18 or between the projection 16 and the guide groove 21 on the inner surface of the guide groove 21. Further, in this case, the guide groove 21 for guiding the projection 16 is preferably in the form of a guide groove 21*b* shown in FIG. 6C. In the vacuum release means, since the ring member 18 is rotated with respect to the body portion 13 as the projection 16 moves along the helical portion of the guide groove 21*b*, it is not necessary to rotate the ink container 1 by hand.

In order to prove the effect of the present invention, experiments 1 and 2 were carried out.

Experiment 1

(Ink Container)

Figure 15:
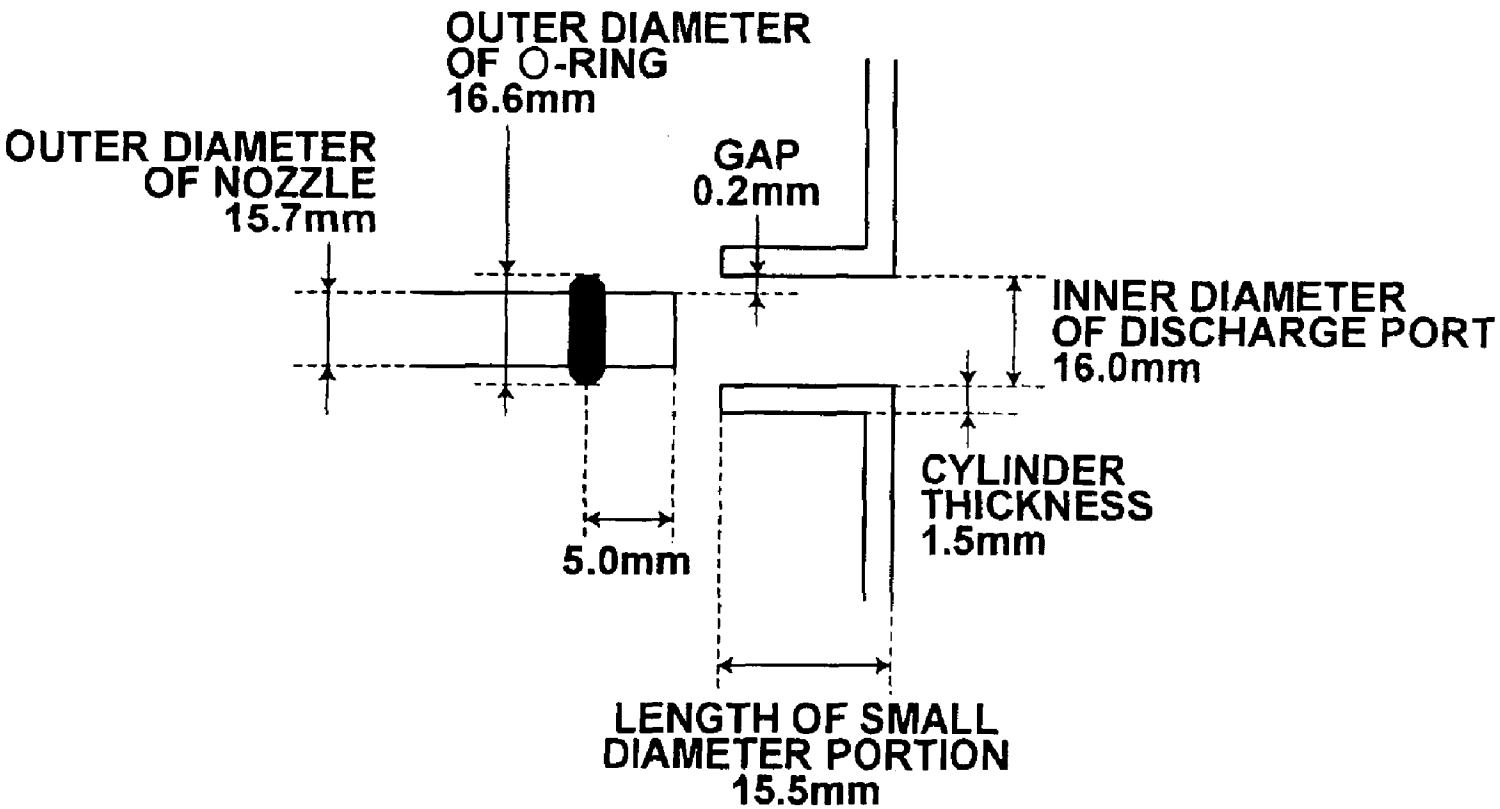
FIG. 15 is a view showing dimensions of various parts of the ink supply system of the present invention.

Two kinds of ink containers (equivalent to a GR-series ink container available from RISO KAGAKU CORPORATION) were prepared. One (container 1) of them was in accordance with an embodiment of the present invention and was provided with a projection, and the other (container 2) of them was not in accordance with the present invention and was provided with no projection. The projection was 20 mm in the distance from the front end of the body portion 13 of the cylinder to the front end of the projection and 105 mm in length. Both the ink containers were formed of polypropylene, and were 16.0 mm, 15.5 mm, 79.5 mm and 1.5 mm as shown in FIG. 15 respectively in inner diameter of the discharge port, length of the small diameter portion, outer diameter of the body portion of the cylinder and cylinder thickness.

(Ink Container Holder)

Figure 11:
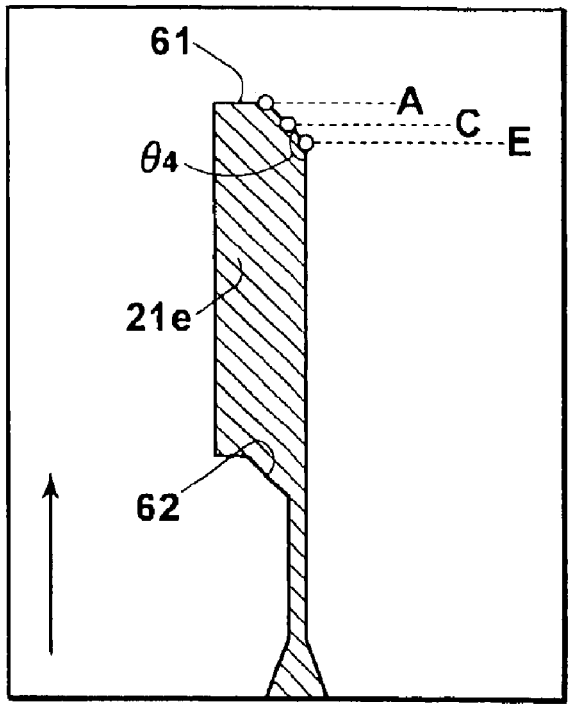
FIG. 11 is a view showing a modification of the guide groove shown in FIG. 8.

A guide groove 21*e* shown in FIG. 11 and adapted to be engaged with the projection on the ink container 1 was formed on the inner surface of the ink container holder. Since the guide groove was designed so that the ink container was helically drawn out from the holder from the point A to the point E by way of the point C, the ink container was helically drawn when the vacuum is broken (point C) irrespective of backlash between the guide groove and the projection. The ink container holder was 107.5 mm in axial length of the guide groove 21*e*, 17° in the circumferential rotating angle and 135° in the drawing angle θ3.

(Ink)

Ink A (6.13 Pa·s in viscosity), Ink B (3.18 Pa·s in viscosity), Ink C (2.86 Pa·s in viscosity), Ink D (1.07 Pa·s in viscosity) and Ink E (0.87 Pa·s in viscosity) were prepared by diluting RP-HD ink (available from RISO KAGAKU CORPORATION) with solvent AF-6 (NIPPON OIL CORPORATION). The viscosity of ink was measured by the use of a stress-control type rheometer (RHEO-STRESS RS75 available from HAAKE). That is, a cone which was 1° in cone angle and 20 mm in diameter was employed and the viscosity at 100 $sec^{-1}$ was measured while the stress was increased 20Pa per second from 0Pa at 23° C.

(Way of Experiment)

The ink containers filled with ink A to ink E were set in sequence to a jig provided with the ink container holder and an ink pump (RP3790 available from RISO KAGAKU CORPORATION). When the ink container was exhausted and ink came not to be discharged from the ink container, the ink pump was stopped and drawing test was carried out three times (n=3) and the state of stain with ink was visually evaluated. The result was as shown in the following table 1. In the drawing test, the container 1 was drawn out from the ink container holder 2 while the ink container 1 was rotated with the protrusion guided by the guide groove, and the container 2 was drawn out from the ink container holder 2 by pulling straight rearward in the axial direction of the ink container holder 2. When the ink container holder 2 was stained with even a drop of ink, the ink container was marked with X in table 1 and when the ink container holder 2 was stained with no ink, the ink container was marked with ○ in table 1. The experiment was carried out at 23° C. As can be seen from the following table 1, by drawing out the ink container from the ink container holder while guiding the ink container by the guide groove, no ink is ejected from the ink container irrespective of ink employed.

TABLE 1

| | n | container 1 | container 2 |
|---|---|---|---|
| ink A (6.13 Pa · s) | 1 | ○ | X |
| | 2 | ○ | ○ |
| | 3 | ○ | X |
| ink B (3.18 Pa · s) | 1 | ○ | X |
| | 2 | ○ | X |
| | 3 | ○ | X |
| ink C (2.86 Pa · s) | 1 | ○ | X |
| | 2 | ○ | X |
| | 3 | ○ | X |
| ink D (1.07 Pa · s) | 1 | ○ | X |
| | 2 | ○ | X |
| | 3 | ○ | X |
| ink E (0.87 Pa · s) | 1 | ○ | X |
| | 2 | ○ | X |
| | 3 | ○ | X |

Experiment 2

The piston-type ink container is generally formed of polypropylene, and accordingly, it is known that the ink container is swollen to some extent when left alone for a long time with ink remaining in the inner space 15.

A plurality of ink containers of the present invention which were different in the distance of the front end of the projection or protrusion from the front end of the body portion of the cylinder (105 mm long) were prepared and the state of stain with ink was evaluated after a swelling test. The ink containers were 79.5 mm in diameter of the body portion. The swelling test was carried out by measuring change of the distance of the front end of the projection or protrusion from the front end of the body portion of the cylinder after each ink container is left alone for 7 days at 70° C. with each ink container filled with ink A. A guide groove 21*e* shown in FIG. 11 was used. The ink container holder was 107.5 mm in axial length of the portion of the guide groove 21*e* where the ink container were rotated, and 135° in the drawing angle θ4. In a state where the ink container was inserted into the ink container holder to the full extent, the O-ring was 10 mm from the front end of the small diameter portion of the ink container before the swelling test. After the swelling test, each ink container was loaded in the ink container holder and was subjected to a drawing test. In the drawing test, each ink container was draw straight after helically rotated by 17°. The ink containers were as shown in FIG. 15 except the projection or protrusion. Evaluation was taken three times. The result was as shown in the following table 2. As can be seen from the following table 2, when the distance of the front end of the projection from the front end of the body portion of the cylinder (105 mm long) is not larger than 35 mm (preferably 30 mm), ejection of ink upon drawing the ink container can be prevented even after the ink container is swollen. When the ink container holder 2 was stained twice or more, the ink container was marked with X in table 2, when the ink container holder 2 was stained only once, the ink container was marked with Δ in table 2, and when the ink container holder 2 was not stained at all, the ink container was marked with ○ in table 2.

TABLE 2

| distance (mm) | change in dimensions due to swelling test (mm) | ink stain |
|---|---|---|
| 0 | 0.00 | ○ |
| 5 | 0.20 | ○ |
| 10 | 0.40 | ○ |
| 15 | 0.60 | ○ |
| 20 | 0.80 | ○ |
| 25 | 1.00 | ○ |
| 30 | 1.20 | ○ |
| 35 | 1.40 | Δ |
| 40 | 1.60 | X |
| 45 | 1.80 | X |

A plurality of ink containers of the present invention which were different in the length of the protrusion (the distance between the front end of the protrusion and the rear end of the protrusion) were prepared and stability in inserting the ink container into the ink container holder before swelling and interference between the protrusion and the guide groove after swelling were evaluated. The ink containers were 79.5 mm in diameter of the body portion. The protrusion on each ink container was shown in FIGS. 7A and 7B, and the distance of the front end of the protrusion from the front end of the body portion of the cylinder was 20 mm. Before the swelling test, the ink containers were set in an ink container holder having a guide groove equivalent to that shown in FIG. 11 and stability in inserting the ink container into the ink container holder before swelling was evaluated. The length of the portion of the guide groove where the ink container were rotated was larger than the length of the protrusion before swelling by 2.5 mm taking into account fitting of the small diameter with the ink suction nozzle. Then the ink containers were subjected to the swelling test in the same manner as described above, and then change of the length of the protrusion was measured and interference between the protrusion and the guide groove was evaluated. Also at this time, the length of the portion of the guide groove where the ink container were rotated was larger than the length of the protrusion before swelling by 2.5 mm taking into account fitting of the small diameter with the ink suction nozzle. The ink containers were as shown in FIG. 15 except the projection or protrusion. Evaluation was taken once (n=1). The result was as shown in the following table 3. In the following table 3, the ink container was marked with ○ when the stability before swelling was good, the ink container was marked with Δ when there was practically no problem though the body portion somewhat rattled, the ink container was marked with X when there was a problem in practical use of the ink container, and the ink container was marked with ○ when there was no interference after swelling, the ink container was marked with Δ when there was practically no problem though rotation of the ink container was somewhat heavy, the ink container was marked with X when there was a problem in practical use of the ink container.

TABLE 3

| protrusion length (mm) | change in dimensions due to swelling test (mm) | stability before swelling test | interference after swelling test |
|---|---|---|---|
| 10 | 0.15 | X | ○ |
| 20 | 0.30 | X | ○ |
| 40 | 0.60 | Δ | ○ |
| 60 | 0.90 | ○ | ○ |
| 80 | 1.20 | ○ | ○ |
| 100 | 1.50 | ○ | ○ |
| 120 | 1.80 | ○ | Δ |
| 140 | 2.10 | ○ | X |
| 160 | 2.40 | ○ | X |

As can be seen from the table 3, when the length of the protrusion is not smaller than 40 mm and not larger than 120 mm (preferably not smaller than 60 mm and not larger than 100 mm), interference between the protrusion and the guide groove can be prevented after swelling, and stability in insertion of the ink container into the ink container holder can be ensured.

From tables 2 and 3, it can be found that when a protrusion such as shown in FIGS. 7A and 7B is provided to a piston-type ink container of polypropylene, the adverse influence of swelling after the ink container is left alone for long can be avoided by designing the distance of the front end of the projection from the front end of the body portion of the cylinder to be not larger than 35 mm (preferably 30 mm) and the length of the protrusion to be not smaller than 40 mm and not larger than 120 mm (preferably not smaller than 60 mm and not larger than 100 mm).

What is claimed is:

1. An ink supply system for a stencil printer comprising an ink container comprising a cylinder provided with a substantially cylindrical body portion and a small diameter portion which is formed on one end of the body portion and is provided with an ink discharge port on its free end, a piston inserted into the body portion of the cylinder to be slidable in the axial direction of the body portion along the inner peripheral surface thereof toward the small diameter portion, and ink filled in the space formed between the inner surface of the body portion and the surface of the piston facing the small diameter portion, an ink suction nozzle which is fitted with the small diameter portion to suck the ink in the ink container through the ink discharge port, a means for sealing the joint between the nozzle and the small diameter portion, and a vacuum release means which at least partly releases vacuum in the space evacuated by the ink suction nozzle before the tip of the nozzle and the tip of the small diameter portion are aligned with each other when the small diameter portion is drawn from the ink suction nozzle.

2. An ink supply system as defined in claim 1 in which the means for sealing the joint between the nozzle and the small diameter portion is an annular elastic sealing member.

3. An ink supply system as defined in claim 2 in which the annular elastic sealing member is an O-ring.

4. An ink supply system as defined in claim 1 in which the vacuum release means comprises a projection provided on one of the outer surface of the ink container and the inner surface of the ink container holder and a guide groove formed on the other of the outer surface of the ink container and the inner surface of the ink container holder to engage with the projection to guide the projection when the ink container is drawn from the ink container holder so that the ink container drawing speed is reduced or the ink container is once stopped to allow the vacuum in said space to be at least partly released before the tip of the nozzle and the tip of the small diameter portion are aligned with each other.

5. An ink supply system as defined in claim 4 in which the guide groove includes a helical portion through which the projection is moved between a time point at which sealing of said space is broken and a time point at which the tip of the nozzle and the tip of the small diameter portion are aligned with each other and which is inclined so that the ink container drawing speed is reduced to allow the vacuum in said space to be at least partly released before the tip of the nozzle and the tip of the small diameter portion are aligned with each other.

6. An ink supply system as defined in claim 4 in which the guide groove is provided with a bent portion through which the projection is moved between a time point at which sealing of said space is broken and a time point at which the tip of the nozzle and the tip of the small diameter portion are aligned with each other and which is bent so that the ink container is once stopped to allow the vacuum in said space to be at least partly released before the tip of the nozzle and the tip of the small diameter portion are aligned with each other.

7. An ink supply system as defined in claim 4 in which the projection is provided on a ring member mounted for rotation on the outer surface of the body portion of the cylinder of the ink container whereas the guide groove to be engaged with the projection is formed on the inner surface of the ink container holder and is provided with a helical portion so that the ink container drawing speed is reduced to allow the vacuum in said space to be at least partly released before the tip of the nozzle and the tip of the small diameter portion are aligned with each other.

8. An ink supply system as defined in claim 4 in which the projection extends on the outer surface of the body portion of the cylinder in the axial direction of the body portion by a length not smaller than the radius of the body portion whereas the guide groove is formed on the inner surface of the ink container holder.

9. An ink supply system as defined in claim 8 in which the front end of the projection abuts against an end face of the guide groove to guide the projection when the ink container is drawn from the ink container holder so that the ink container drawing speed is reduced or the ink container is once stopped.

10. An ink supply system as defined in claim 9 in which the front end of the projection is at a distance from the front face of the body portion of the cylinder in the range not smaller than 0 mm and not larger than 35 mm.

11. An ink supply system as defined in claim 9 in which the body portion of the cylinder is smaller than 100 mm in its diameter and the projection is not larger than 120 mm in its length when.

12. An ink supply system as defined in claim 1 in which the ink suction nozzle is fitted in the small diameter portion and the vacuum release means comprises a plurality of small vent holes formed along the small diameter portion of the ink container.

13. An ink container comprising a cylinder provided with a substantially cylindrical body portion and a small diameter portion which is formed on one end of the body portion and is provided with an ink discharge port on its free end, a piston inserted into the body portion of the cylinder to be slidable in the axial direction of the body portion along the inner peripheral surface thereof toward the small diameter portion, and ink filled in the space formed between the inner surface of the body portion and the surface of the piston facing the small diameter portion, and inserted into an ink container holder of a stencil printer so that an ink suction nozzle of the stencil printer is fitted with the small diameter portion to suck the ink in the ink container through the ink discharge port, wherein the improvement comprises a vacuum release means which at least partly releases vacuum in the space evacuated by the ink suction nozzle before the tip of the nozzle and the tip of the small diameter portion are aligned with each other when the ink container is drawn from the ink container holder.

14. An ink container as defined in claim 13 in which the vacuum release means comprises a projection provided on one of the outer surface of the ink container and the inner surface of the ink container holder and a guide groove formed on the other of the outer surface of the ink container and the inner surface of the ink container holder to engage with the projection to guide the projection when the ink container is drawn from the ink container holder so that the ink container drawing speed is reduced or the ink container is once stopped to allow the vacuum in said space to be at least partly released before the tip of the nozzle and the tip of the small diameter portion are aligned with each other.

15. An ink container as defined in claim 14 in which the guide groove includes a helical portion through which the projection is moved between a time point at which sealing of said space is broken and a time point at which the tip of the nozzle and the tip of the small diameter portion are aligned with each other and which is inclined so that the ink container drawing speed is reduced to allow the vacuum in said space to be at least partly released before the tip of the nozzle and the tip of the small diameter portion are aligned with each other.

16. An ink container as defined in claim 14 in which the guide groove is provided with a bent portion through which the projection is moved between a time point at which sealing of said space is broken and a time point at which the tip of the nozzle and the tip of the small diameter portion are aligned with each other and which is bent so that the ink container is once stopped to allow the vacuum in said space to be at least partly released before the tip of the nozzle and the tip of the small diameter portion are aligned with each other.

17. An ink container as defined in claim 14 in which the projection is provided on a ring member mounted for rotation on the outer surface of the body portion of the cylinder of the ink container whereas the guide groove to be engaged with the projection is formed on the inner surface of the ink container holder and is provided with a helical portion so that the ink container drawing speed is reduced to allow the vacuum in said space to be at least partly released before the tip of the nozzle and the tip of the small diameter portion are aligned with each other.

18. An ink container as defined in claim 14 in which the projection extends on the outer surface of the body portion of the cylinder in the axial direction of the body portion by a length not smaller than the radius of the body portion whereas the guide groove is formed on the inner surface of the ink container holder.

19. An ink container as defined in claim 18 in which the front end of the projection abuts against an end face of the guide groove to guide the projection when the ink container is drawn from the ink container holder so that the ink container drawing speed is reduced or the ink container is once stopped.

20. An ink container as defined in claim 19 in which the front end of the projection is at a distance from the front face of the body portion of the cylinder in the range not smaller than 0 mm and not larger than 35 mm.

21. An ink container as defined in claim 19 in which the body portion of the cylinder is smaller than 100 mm in its diameter and the projection is not larger than 120 mm in its length when.

22. An ink container as defined in claim 13 in which the ink suction nozzle is fitted in the small diameter portion and the vacuum release means comprises a plurality of small vent holes formed along the small diameter portion of the ink container.

23. A method of supplying ink to a stencil printer comprising the steps of inserting an ink container comprising a cylinder provided with a substantially cylindrical body portion and a small diameter portion which is formed on one end of the body portion and is provided with an ink discharge port on its free end, a piston inserted into the body portion of the cylinder to be slidable in the axial direction of the body portion along the inner peripheral surface thereof toward the small diameter portion, and ink filled in the space formed between the inner surface of the body portion and the surface of the piston facing the small diameter portion, into an ink container holder of the stencil printer so that an ink suction nozzle of the stencil printer is fitted with the small diameter portion to suck the ink in the ink container through the ink discharge port, and drawing out the ink container from the ink container holder of the stencil printer when the ink container is exhausted, wherein the improvement comprises the step of at least partly releasing vacuum in the space evacuated by the ink suction nozzle before the tip of the nozzle and the tip of the small diameter portion are aligned with each other when the small diameter portion is drawn out from the ink suction nozzle.

24. A method as defined in claim 23 in which the vacuum is released by reducing the ink container drawing speed before the tip of the nozzle and the tip of the small diameter portion are aligned with each other.

25. A method as defined in claim 23 in which the vacuum is released by once stopping the ink container before the tip of the nozzle and the tip of the small diameter portion are aligned with each other.

* * * * *